United States Patent [19]

Uher

[11] 4,092,159

[45] May 30, 1978

[54] FLUX FOR METAL CASTING

[75] Inventor: Joseph F. Uher, Timonium, Md.

[73] Assignee: SCM Corporation, Cleveland, Ohio

[21] Appl. No.: 807,465

[22] Filed: June 17, 1977

[51] Int. Cl.[2] ..... C22B 9/10

[52] U.S. Cl. ..... 75/257; 75/53; 164/55; 164/56

[58] Field of Search ..... 75/257, 53; 148/20; 164/53, 56, 82

[56] References Cited

U.S. PATENT DOCUMENTS

| | | | |
|---|---|---|---|
| 3,027,227 | 3/1962 | Coxey | 75/53 |
| 3,320,052 | 5/1967 | Bowden | 75/53 |
| 3,926,246 | 12/1975 | Corbett | 75/257 |

*Primary Examiner*—P. D. Rosenberg

*Attorney, Agent, or Firm*—Merton H. Douthitt; James B. Wilkens

[57] ABSTRACT

A flux for metal casting comprising an intimate blend of two parts is described. One part comprises a glass network former vitrified with a fluxing agent therefor, while the other part comprises a fluorine-providing material, said two parts being proportioned to provide on melting in the casting operation a glass of the desired fluorine content.

7 Claims, No Drawings

FLUX FOR METAL CASTING

FIELD OF THE INVENTION

This invention relates to flux for use in the casting of metals such as steels, particularly the continuous casting of such metals, and to process for making said flux.

BACKGROUND OF THE INVENTION

Heretofore a variety of fluxes, also known as mold powders or slags, have been proposed for the continuous casting of metals, particularly steel, but also copper and brass. The main functions of these fluxes are to protect the molten metal from air oxidation and to flux or solubilize and remove oxide impurities present in the melt. Additionally, lubrication of and heat transfer in the casting mold often can be enhanced by use of such flux. Typically, the flux is fed or poured on the top surface of the molten metal in the mold. Occasionally, this top surface is referred to as the meniscus.

Continuous casting of steels including aluminum- or silicon-killed steels, austenitic stainless steels, etc., is perhaps the largest user of such flux. There have been essentially two types of flux used in this connection. One is a powdery mixture of particulates, such as fly ash, silica, lime, borax, and the like. The other consists essentially of particulates of vitrified or fritted glass material ordinarily containing smeltedin halogen, especially fluorine. An example of the first type is shown in U.S. Pat. Nos. 3,642,052 and 3,788,840; of the second type, the vitrified fluxes shown in U.S. Pat. Nos. 3,649,249, 3,899,324, 3,926,246, and 3,704,744. The latter type ordinarily is the more expensive, but it is often considered necessary or desirable. The teachings of this latter group of patents are incorporated herein expressly by reference. The advantages of the instant invention will be apparent from the detailed description which follows.

BROAD STATEMENT OF THE INVENTION

In one aspect, this invention is a flux for metal casting comprising two parts, one part including glass network former and fluxing agent therefor and vitrified therewith, the other part including discrete fluorine-providing material adapted for intimate blending and vitrification with said one part, said parts being proportioned for furnishing upon their melting in a metal casting operation a glass of desired fluorine content.

Another aspect of this invention is the process for preparing such flux. It comprises the forming of particulates of the vitrified part of the flux, and the intimate blending of these particulates with the requisite proportion of fluorine-providing material, also in particulate form.

DETAILED DESCRIPTION OF THE INVENTION

The vitrified fraction is made conventionally in a smelter or the like. Linings of smelters or kilns are susceptible to attack by halides and/or especially fluorine-containing ingredients. Such attack is manifested usually as dissolution of the brick lining, thereby causing periodic, if not frequent, repairs. However, halides and particularly fluorides or fluorine-providing ingredients are necessary for making frits such as those used in continuous casting of metals. At or approaching smelting temperatures some fluorides are lost to the stack through volatilization. or otherwise, which loss would require recovery or removal of such component, from the stack vapor effluent. Thus, smelting a raw batch having little to no fluoride (or fluorine-providing ingredients) would increase measurably the life of smelters' linings as well as reduce production cost due to elimination of recovery procedures. However, some fluorine (up to about 5% by weight) can be smelted into a frit with tolerable smelter lining deterioration and consequent additional maintenance. Molten glass in the smelter conventionally is fritted by pouring a stream of the glass into water or by fracturing it subsequent to passage between chilled rolls. Often the resulting frit is milled (ground) to −150 mesh (Tyler Standard) or finer for use as a continuous casting flux.

The vitrified first part of the instant flux is a frit made basically from glass network former and flux. Such frit, of course, can be, and usually is modified with glass modifiers. The glass network formers contemplated by the present invention include silica, alumina, and phosphorus pentoxide and boria. The raw glass batch usually is in the form of minerals and chemicals of purity satisfactory for glass making, which is a prudent criterion. Fluxes for the glass network formers include alkali metal oxides and alkaline earth metal oxides. Typical modifiers for these glasses include various metal oxides, such as ferric oxide, manganese oxide, titanium dioxide, zirconium dioxide. The purpose of the modifiers is normally to adjust some properties of the frit such as its viscosity, softening point, etc. The vitrified part of the instant flux can be one or a plurality of frits, in which case the frits can be agglomerated such as by sintering. However, mere mechanical mixing of the frits is adequate and preferred.

The fluorine-providing material can be simple or complex fluoride salts, typically fluorspar, cryolite, alkali metal or alkaline earth metal fluorides, and alkali metal fluosilicates. Where the melting temperature of the metal being cast is high, such as steel, the preferred and most practical fluorine-providing raw material is fluorspar, either synthetic or natural.

For most continuous casting processes it is important that little or no water be introduced with the flux. Accordingly, the fluxes preferably are maintained dry and, even more preferably are not made of hygroscopic components. They can be packaged and stored in a manner as to prevent water pick-up. However, it is preferred to use fluxes that are not susceptible to appreciable water pick-up when normally stored unprotected. The presence of even small amounts of absorbed moisture (e.g. 5+ % by wt. of flux) for steel casting can cause excessive oxidation. To prevent and/or minimize this problem, at least about 3 to 7% equivalent of alkaline earth oxide is included advantageously in the raw material batch for the frit to be smelted. In some cases, this may require use of a few percent calcium fluoride in the glass batch.

Typically, the instant fluxes are made by mechanically blending the fine powders of the vitrified component or components and the fluorine-providing material. In such operation, there is often added up to about 5 to 10% by weight of powdered graphite to the flux for the purpose of minimizing heat loss from the molten metal.

Broad and preferred ranges of frit composition for making the instant flux for the continuous casting of steels are as follows:

| Ingredient | % Broad | % Preferred |
|---|---|---|
| $SiO_2$ | 10–50 | 15–40 |
| $Al_2O_3$ | 0–20 | 0–10 |
| $P_2O_5$ | 0–40 | 0–15 |
| $B_2O_3$ | 0–15 | 0–7 |
| $Na_2O$ | 3–40 | 10–30 |
| $K_2O$ | 0–10 | 1–6 |
| $Li_2O$ | 0–10 | 1–5 |
| CaO | 10–50 | 15–35 |
| MgO | 0–15 | 0–10 |
| BaO | 0–15 | 0–10 |
| SrO | 0–15 | 0–10 |
| Metals | 0–4 | 0–2 |

Desirable flowidity or Herty viscosity and plastic deformation properties for such frits are as follows:

Broad flowidity 2" to 16" and preferably 6" to 12" at 1425° C.

Broad Plastic Deformation from 700° to 1200° C., and preferably 800° to 900° C.

The flowiditiy is measured by Herty Viscosimeter as outlined in U.S. Pat. No. 2,649,249.

The instant multicomponent flux comprising a smelted glass frit and a fluorine-providing substance has been found to be fully equivalent in use on a steel caster to fluxes in which all fluorides are smelted in. Although the melting point of calcium fluoride is reported in literature as being 1360° C., the fluorspar which may be present as a discrete component in the glassy mixture very quickly melts almost simultaneously with the glass component. This probably is due to the rapid interaction to form various low melting eutectics. In any case, however, the softening range, softening point, viscosity as determined by the aforementioned Herty Viscosimeter, and other test measurements used to predict operational behavior on the caster are observed to be essentially indentical whether the fluorine-providing substance was smelted into the flux or added as a discrete component in accordance with this invention. Additionally, lubrication of the mold, blanketing thereof against atmospheric oxygen ingress, and removal of undersirable oxide inclusions, such as silica and alumina, are equally as efficient using the inventive flux as a completely fritted flux.

Furthermore, the presence of discrete unvitrified fluorine-providing substance in the flux does not result in the generation of fluoride emissions or fumes above the caster in a volume and concentration to constitute a potential hazard. This lack of substantial fluoride emission is believed to be due to the very short time the material is exposed to temperatures above about 1315° C. where such fuming might take place. Also, the fact that the molten flux is covered with the unmelted powdered flux mixture minimizes the escape of any such fluoride fumes by acting as a solid condenser to such vapors. The flux is rapidly chilled also, as it moves down between the forming steel strand shell and the water-cooled mold.

The following examples show ways in which the invention has been practiced, but should not be construed as limiting the invention. In this operation, all parts are parts by weight, all percentages are weight percentages, all temperatures are in °Centigrade, and all particle sizes are in the Tyler Standard Sieve Series unless otherwise especially noted.

EXAMPLE I

Two mold fluxes were prepared. One, by the tradional method of smelting all ingredients together, fritting the glass, then milling to essentially minus 150 mesh mixing with 5% graphite and using as such on the caster. The second flux was smelted with most of the fluoride ingredient removed, fritted, milled to essentially minus 150 mesh, then mixed with the fluoride ingredient, in this case fluorspar, $CaF_2$, and the whole then mixed with 5% graphite and used on the caster.

The first such flux used the following raw materials:

| | | |
|---|---|---|
| $SiO_2$ | 26.6 | pounds |
| $Na_2CO_3$ | 33.3 | pounds |
| $CaF_2$ | 19.3 | pounds |
| $CaCO_3$ | 12.6 | pounds |
| $Li_2CO_3$ | 5.0 | pounds |
| $K_2CO_3$ | 3.2 | pounds |
| | 100.0 | pounds |

The above raw materials were intimately mixed, smelted at about 1200° C., fritted by pouring the molten glass through counterrotating, water-cooled rolls, and milled to essentially minus 150 mesh. The composition as fritted was as follows on an oxide basis:

| | |
|---|---|
| $SiO_2$ | 35.2% |
| $Na_2O$ | 24.8% |
| $K_2O$ | 2.5% |
| $Li_2O$ | 2.4% |
| CaO | 26.7% |
| F | 10.8% |
| | 102.4% |

(In excess of 100% since $F_2$ is actually combined as a metal fluoride, replacing oxygen, but unidentifiable as such.)

Based on the fluoride content of the raw batch, the theoretical fluorine content in the smelted material should have been 12.1%, indicating a significant loss of fluorine by volatilization up the smelter stack, usually in the form of HF.

The fusion range of this flux was 925° to 950° C. and the viscosity was 8½ inches as measured by the Herty Viscosimeter at 1425° C.

A second frit was smelted, fritted, and milled as above using the following raw materials:

| | | |
|---|---|---|
| $SiO_2$ | 26.6 | pounds |
| $Na_2CO_3$ | 33.3 | pounds |
| $CaF_2$ | 7.7 | pounds |
| $CaCO_3$ | 12.6 | pounds |
| $Li_2CO_3$ | 5.0 | pounds |
| $K_2CO_3$ | 3.2 | pounds |
| | 88.4 | pounds |

The second frit containing about one-third of the fluorine content of the first was dry-mixed with additional 11.6 pounds of pulverant $CaF_2$ to make up a total of 19.3 pounds, the same $CaF_2$ used in the first frit. The resulting mixture, on an oxide basis and apart from fluorine content was exactly the same as the first frit. The fluorine content of such mixture, however, was 12%. This indicated a loss of only about 0.1 pound from theoretical by volatilization during the frit smelting.

The fusion range of this flux was measured at 925° to 950°, and the viscosity was 8¼ inches as measured by the Herty Viscosimeter at 1425°, essentially the same as the first flux.

Smelter liner refractory attack studies were made of the above two frits (as smelted) by exposing a zirconium silicate refractory bar to each for 24 hours at 1040°. The changes in the refractory bars after such exposure were as follows:

| | Change in Thickness at Bath Line |
|---|---|
| Conventional all-fritted flux - (all fluoride smelted in) | −100 mils |
| Flux of this invention - | − 50 mils |

Samples of each of the fluxes described above in the ready-to-use condition, except for addition of graphite, were exposed for a period of three months to ambient conditions of temperature (25 ± 5° C.) and relative humidity of about 40% ± 20%.

The conventional all-fritted flux gained 3.91% moisture, whereas the inventive flux (mixture), two-thirds of the fluoride added as a discretely blended calcium fluoride, absorbed 3.22% moisture. This test illustrated that sharp reduction of calcium fluoride did not generate a high affinity for moisture in the final product, as might have been expected.

The two fluxes described above were mixed with about 5% graphite and used on a production continuous slab caster in separate runs. The results obtained were essentially identical, and no significant differences could be observed in any operating parameters or properties of cast steel.

By use of the exemplified procedure wherein all or a large part of the fluoride component of the flux is withheld during smelting and added later to the powdered frit, it is easily possible to make rapid and easy changes in fluoride content of the final mold powder. Changes in properties, such as softening range, viscosity, and even solubility of inclusions from the steel can be modified as required to adjust the flux to the varying requirements of caster operation or the specific needs of steels being cast. This kind of flexibility is not available with presently commercial vitreous fluxes.

I claim:

1. In a process for producing a flux suitable for use in the continuous casting of metal from raw materials comprising a glass network former, a fluxing agent therefor and a fluorine-providing material adapted for vitrification with said network former and said fluxing agent, the improvement which comprises:

(A) smelting together the vitrifiable raw materials for said flux, but not more of said fluorine-providing material than corresponds to about 5% by weight of fluorine, to form a molten glass;

(B) cooling said molten glass to form a vitrified frit therefrom; and (C) blending particles of said vitrified frit with discrete unvitrified particles of said fluorine-providing material to form said flux comprising the vitrified frit particles and the discrete unvitrified particles of fluorine-providing material.

2. A process according to claim 1 wherein said metal is steel.

3. A process according to claim 2 wherein said discrete unvitrified particles of fluorine-providing material consist essentially of fluorspar.

4. A process according to claim 2 wherein said glass network former consists essentially of silica, alumina, phosphorous pentoxide or boria and said fluxing agent consists essentially of an alkali metal oxide or an alkaline earth metal oxide.

5. A process according to claim 4 wherein said discrete unvitrified particles of fluorine-providing material consist essentially of fluorspar.

6. A process according to claim 2 wherein said vitrifiable raw materials in step (A) further comprise metal oxide modifiers.

7. A process according to claim 2 further comprising blending up to 10% of powdered graphite with said vitrified frit particles and said discrete unvitrified particles of fluorine-providing material, whereby said flux further comprises said powdered graphite.

* * * * *